US011326490B2

(12) United States Patent
Mollmann et al.

(10) Patent No.: US 11,326,490 B2
(45) Date of Patent: May 10, 2022

(54) VARIABLE RESTRICTION VALVE FOR VEHICLE EXHAUST SYSTEM

(71) Applicant: Faurecia Emissions Control Technologies, USA, LLC, Columbus, IN (US)

(72) Inventors: Chad Mollmann, Royal Oak, MI (US); James Egan, Greenwood, IN (US); Brandon Sobecki, Columbus, IN (US); Sebastien Royer, Dasle (FR)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 918 days.

(21) Appl. No.: 15/968,942

(22) Filed: May 2, 2018

(65) Prior Publication Data

US 2019/0338686 A1 Nov. 7, 2019

(51) Int. Cl.
*F01N 1/16* (2006.01)

(52) U.S. Cl.
CPC ..... *F01N 1/165* (2013.01)

(58) Field of Classification Search
CPC ..... F01N 1/165; F01N 1/166
USPC ..... 181/229, 258
See application file for complete search history.

(56) References Cited

U.S. PATENT DOCUMENTS 1,578,668 A * 3/1926 Kirkpatrick ..... F02M 1/00 48/189.6
2,649,272 A * 8/1953 Barbato ..... F16K 3/03 251/212
2,934,892 A * 5/1960 Hurlbert ..... F02K 1/10 239/265.39
4,161,996 A 7/1979 Dolejsi
4,211,304 A * 7/1980 Matthews ..... F01N 1/24 181/248
4,211,305 A * 7/1980 Matthews ..... F01N 1/16 181/248
4,299,305 A * 11/1981 Eriksson ..... F01N 1/16 181/230
4,377,968 A * 3/1983 Gerry ..... F24F 13/08 454/213
5,340,291 A * 8/1994 Benckert ..... F04B 15/02 137/515

(Continued)

FOREIGN PATENT DOCUMENTS

CN 105781681 A 7/2016
EP 0432483 A1 * 6/1991 ..... F01N 3/2892

(Continued)

*Primary Examiner* — Jeremy A Luks
(74) *Attorney, Agent, or Firm* — Carlson, Gaskey & Olds, P.C.

(57) ABSTRACT

A valve assembly for a vehicle exhaust system includes a rigid mount structure that is configured to be mounted within an exhaust component that defines an exhaust gas passage. The valve assembly further includes a plurality of flexible members that each extend from a first end to a second end. One of the first ends and second ends of the flexible members is fixed to the rigid mount structure and the other of the first ends and second ends is free to move such that the plurality of flexible members creates a variable restriction to flow through the exhaust component that varies in response to a pressure difference upstream and downstream of the plurality of flexible members.

22 Claims, 5 Drawing Sheets

(56) References Cited

U.S. PATENT DOCUMENTS

| | | | | |
|---|---|---|---|---|
| 6,065,564 | A | 5/2000 | Uegane | |
| 7,987,872 | B2 * | 8/2011 | Bouhaj | G05D 7/012 138/45 |
| 9,566,145 | B2 * | 2/2017 | Trainor | A61F 2/04 |
| 9,795,087 | B2 * | 10/2017 | Ward | B65D 88/28 |
| 2004/0065503 | A1 | 4/2004 | Uegane et al. | |
| 2005/0165356 | A1 * | 7/2005 | Pasqualucci | A61B 17/3462 604/167.06 |
| 2005/0178612 | A1 | 8/2005 | Nohl et al. | |
| 2009/0302252 | A1 | 12/2009 | Cheung | |
| 2011/0146250 | A1 * | 6/2011 | Vanvolsem | F01N 3/2006 60/297 |
| 2011/0303864 | A1 | 12/2011 | Lee | |

FOREIGN PATENT DOCUMENTS

| | | | | |
|---|---|---|---|---|
| JP | S6196117 | A | 5/1986 | |
| JP | 08189329 | A * | 7/1996 | F01N 1/166 |

* cited by examiner

VARIABLE RESTRICTION VALVE FOR VEHICLE EXHAUST SYSTEM

TECHNICAL FIELD

The subject invention relates to a passive valve comprised of a plurality of flexible members that provide a variable restriction in a vehicle exhaust system.

BACKGROUND OF THE INVENTION

Exhaust systems are widely known and used with combustion engines. Typically, an exhaust system includes exhaust tubes or pipes that convey hot exhaust gases from the engine to other exhaust system components, such as catalysts, mufflers, resonators, etc. Exhaust components systems generate various forms of resonances, which result in undesirable noise. Spring/mass-like resonances occur at relatively low frequencies, e.g. below 100 Hz. This type of resonance occurs when the exhaust gas within a pipe acts as a mass and the exhaust gas in muffler volumes act as springs. The system also generates standing waves which comprise acoustic resonances in the pipes themselves. These standing waves are most prevalent in the longest pipes of the system. The frequency of these standing waves is a function of pipe length. Typically, these standing waves occur above 100 Hz. Addressing these standing wave and spring/mass noise issues increases system cost and weight.

Powertrain technology is continually pushing the exhaust sound that needs to be attenuated to lower and lower frequencies. Noise reducing solutions traditionally have included increasing volume or utilizing valves. Mufflers and resonators include acoustic volumes that cancel out sound waves carried by the exhaust gases. Although effective, these components are often relatively large in size and provide limited nose attenuation. Valves have also been used to provide noise attenuation; however, the use of valves further increases cost as well as having additional drawbacks. Current active and passive valve solutions used to address system resonances all suffer from one or more of noise, vibration, harshness (NVH) issues such as flutter, rattle, impact, and squeaking for example. Thus, solutions are needed to more effectively attenuate lower frequency noise without increasing cost and weight, and without introducing the aforementioned NVH issues.

SUMMARY OF THE INVENTION

In one exemplary embodiment, a valve assembly for a vehicle exhaust system includes a rigid mount structure that is configured to be mounted within an exhaust component that defines an exhaust gas passage. The valve assembly further includes a plurality of flexible members that each extend from a first end to a second end. One of the first ends and second ends of the flexible members is fixed to the rigid mount structure and the other of the first ends and second ends is free to move such that the plurality of flexible members creates a variable restriction to flow through the exhaust component that varies in response to pressure difference upstream and downstream of the plurality of flexible members.

In a further embodiment of the above, at least some of the flexible members partially overlap each other, and the freely movable ends bend from an initial position to increase an open area within the exhaust gas passage in response to increased exhaust gas pressure above a predetermined level, and the freely moveable ends return to the initial position when exhaust gas pressure falls below the predetermined level.

In a further embodiment of any of the above, when in the initial position, the freely movable ends of the plurality of flexible members are spaced apart from each other to define an open space radially inward of the freely movable ends, and the freely movable ends bend from the initial position to increase the open space within the exhaust gas passage in response to increased exhaust gas pressure above the predetermined level.

In a further embodiment of any of the above, the rigid mount structure comprises an outer band defining an inner surface surrounding the exhaust gas passage, and wherein the flexible members extend outwardly from the inner surface toward a center of the exhaust gas passage.

In a further embodiment of any of the above, the rigid mount structure comprises an inner mount positioned within the exhaust gas passage to define a mount interface that is spaced from an inner surface of the exhaust component, and wherein the flexible members extend outwardly from the mount interface toward the inner surface of the exhaust gas passage.

In a further embodiment of any of the above, the plurality of flexible members comprises a plurality of stiffener members that are inside a flexible material.

In a further embodiment of any of the above, the plurality of flexible members comprises a plurality of bristles.

In another exemplary embodiment, a vehicle exhaust component assembly includes an exhaust component body having an inner surface defining an exhaust gas passage, a rigid mount structure positioned within the exhaust gas passage, and a plurality of flexible members each extending from a first end to a second end. The plurality of flexible members comprise a plurality of bristles or stiffeners. The first ends of the flexible members are fixed to the rigid mount structure and the second ends are free to move such that the plurality of flexible members creates a variable restriction to flow through the exhaust component body that varies in response to a pressure difference upstream and downstream of the plurality of flexible members. The freely movable ends bend from an initial position to increase an open area within the exhaust gas passage in response to increased exhaust gas pressure above a predetermined level, and the freely moveable ends return to the initial position when exhaust gas pressure falls below the predetermined level.

In a further embodiment of any of the above, a guide is positioned downstream from the plurality of flexible members to define a bend stop position for the flexible members when the exhaust gas pressure exceeds the predetermined level.

These and other features of the present invention can be best understood from the following specification and drawings, the following of which is a brief description.

DETAILED DESCRIPTION

Figure 1:
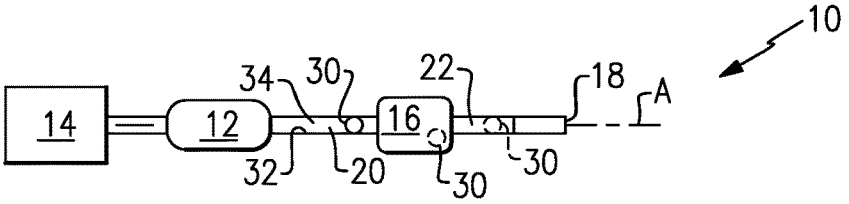
FIG. 1 shows a schematic view of a vehicle exhaust system with at least one variable restriction valve incorporating the subject invention.

As shown in FIG. 1, an exhaust system 10 includes a plurality of exhaust components 12 that convey hot exhaust gases from an engine 14 to other exhaust system components 16, such as catalysts, mufflers, resonators, etc., and eventually to the external atmosphere via a tailpipe 18. FIG. 1 represents a simplified system that includes at least an inlet pipe 20, the muffler component 16, and an outlet pipe 22. The exhaust system 10 includes one or more variable restriction valves 30 that can be mounted in any of various locations within the exhaust system 10. The variable restriction valves 30 operate to provide a simple and low-cost solution for reducing low frequency noise within the exhaust system 10.

In the example shown in FIG. 1, the variable restriction valve 30 is shown as being located within the inlet pipe 20; however, it should be understood that the valve 30 could be located within the muffler 16 or outlet pipe (see dashed lines in FIG. 1) instead of, or in addition to, the valve 30 being located within the inlet pipe 20. Further, the variable restriction valve 30 could also be located within other types of exhaust components which require additional noise attenuation. The inlet pipe 20 includes an inner surface 32 that defines an exhaust gas passage 34 that extends along an axis A. The valve 30 is positioned with the exhaust gas passage 34 to create a restriction in the flow to provide acoustic benefits especially at low frequencies and for standing waves in the inlet pipe 20. This restriction is not fixed and can change as a function of exhaust gas pressure drop across the valve.

In one example, the valve 30 includes a plurality of flexible members 36 that are configured to deflect away from a high pressure location towards a low pressure location. This results in a more open, i.e. less restrictive, exhaust gas passage 34 for the exhaust gas to flow through. This will provide a significantly higher back pressure than normal at low flow levels when the pressure drop is low enough such that the valve is mostly closed; however, as the pressure drop increases, the restriction will decrease such that the pressure drop (while still higher than at the low flow levels) is much lower than it would be for a fixed restriction.

Figure 2:
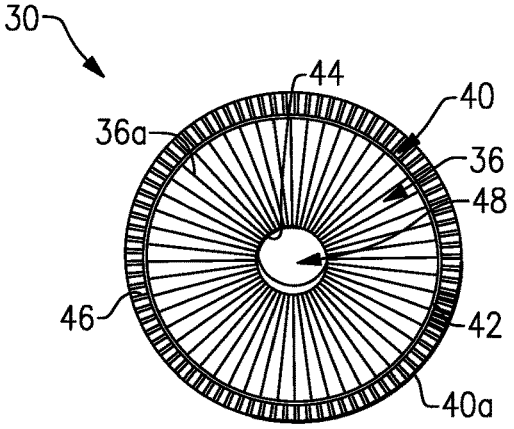
FIG. 2 shows one example of a variable restriction valve from the system of FIG. 1.
Figure 3:
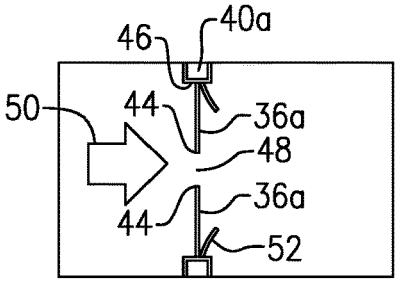
FIG. 3 is a side view of the example of FIG. 2.

FIGS. 2-3 show one example of a valve 30 that includes a rigid mount structure 40 that is configured to be mounted within the inlet pipe 20. The plurality of flexible members 36 each extend from a first end 42 to a second end 44. In one example, at least some of the flexible members 36 partially overlap each other and/or are in contact with each other which provides for an increased density of the members 36 within a specified area. The first ends 42 are fixed to the rigid mount structure 40 and the second ends 44 comprise freely moveable ends 44 such that the plurality of flexible members 36 creates the variable restriction that varies in response to changes in exhaust gas pressure. The freely movable ends 44 are configured to bend from an initial position to increase an open area within the exhaust gas passage 34 in response to increased exhaust gas pressure above a predetermined level, and then return to the initial position when the exhaust gas pressure falls below the predetermined level.

In the example shown in FIGS. 2-3, the rigid mount structure 40 comprises an outer band 40*a* having an inner surface 46 and the flexible members 36 comprise a plurality of bristles 36*a* that are made from metal or other high temperature resistant material. The bristles 36*a* have their first end 42 fixed to the inner surface 46 of the outer band 40*a* with the second, moveable free ends 44 extend in a radially inward direction toward a center of the exhaust gas passage 34. In this example, the free ends 44 do not extend to contact each other which leaves at least one area or space 48, e.g. an annulus, which defines a minimum open flow passage. As shown in FIG. 3, exhaust gas flow 50 exerts pressure against the bristles 36*a* such that the free ends 44 bend or flex in the downstream direction to increase the size of the open space 48.

In one example, the valve 30 further includes an optional guide 52 that is positioned downstream of the bristles 36*a*. The guide 52 comprises a flange or rim that is bent or curved to define a bend stop position for the bristles 36*a* when the exhaust gas pressure exceeds the predetermined level. The guide 52 also serves to reduce stress on the bristles. This will prevent the bristles 36*a* from becoming permanently deformed. The guide 52 is mounted to the inner surface 46 of the band 40*a*, or optionally can be mounted to the inner surface 32 of the pipe 20.

Figure 4A:
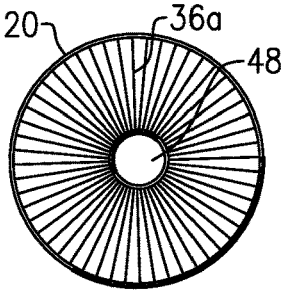
FIG. 4A shows another example embodiment.

In the example shown in FIG. 2, the open space 48 comprises a circular shape that is concentric with the axis A. FIGS. 4A-H show other example configurations for the bristles 36*a*. FIG. 4A shows a view similar to FIG. 2 but depicts an example without an outer band such that the rigid mount comprises the inner surface 32 of the pipe itself. Thus, the bristles 36*a* in any of the example configurations could be mounted directly to the pipe 20 or mounted to the band 40*a* which is fit within the pipe 20.

Figure 4B:
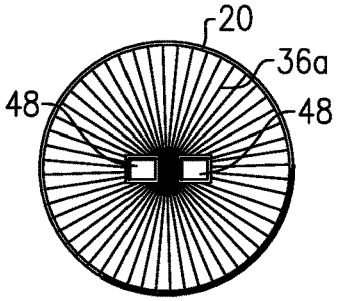
FIG. 4B shows another example embodiment.

FIG. 4B shows an example where the open space 48 comprises at least two or more open spaces 48, which are shown as being non-centric with the axis A. Further these spaces 48 are shown as having a non-circular shape, e.g. polygonal shape, however, the spaces could also be circular or elliptical.

Figure 4C:
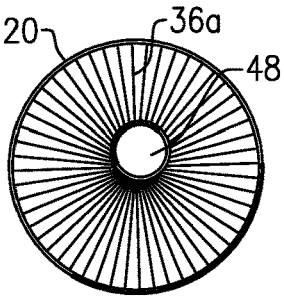
FIG. 4C shows another example embodiment.

FIG. 4C shows an example where the open space 48 is circular but is non-concentric with the axis A. The space 48 can be located anywhere within the cross-section of the pipe 20 as determined to provide the best acoustic performance.

Further, while the space 48 is shown as being circular, the space could also be non-circular.

Figure 4D:
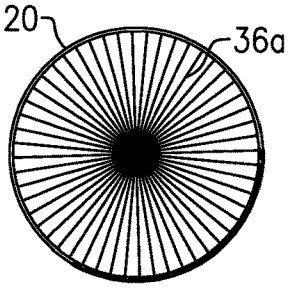
FIG. 4D shows another example embodiment.

FIG. 4D shows an example that eliminates the open space 48. In this configuration, the free ends 44 extend until at least some of them contact each other to close off any open space.

Figure 4E:
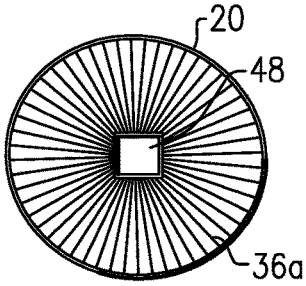
FIG. 4E shows another example embodiment.

FIG. 4E shows an example where the open space is polygonal and concentric with the axis A.

Figure 4F:
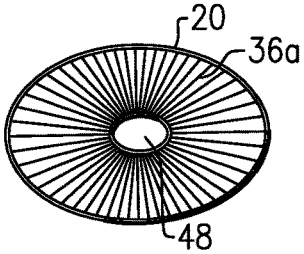
FIG. 4F shows another example embodiment.

FIG. 4F shows an example where the pipe 20 has an elliptical shape with the open space 48 having a corresponding elliptical shape. The open space 48 is shown as being concentric with the axis A; however, the space could also be non-concentric.

Figure 4G:
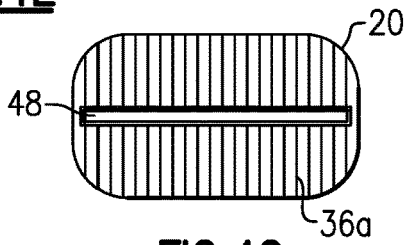
FIG. 4G shows another example embodiment.

FIG. 4G shows an example where the pipe 20 has a polygonal shape with an open space 48 that also has a polygonal shape. In the example shown, the pipe 20 comprises a rectangular shape and the open space 48 comprises a narrow rectangular shape that extends across a width of the pipe 20.

Figure 4H:
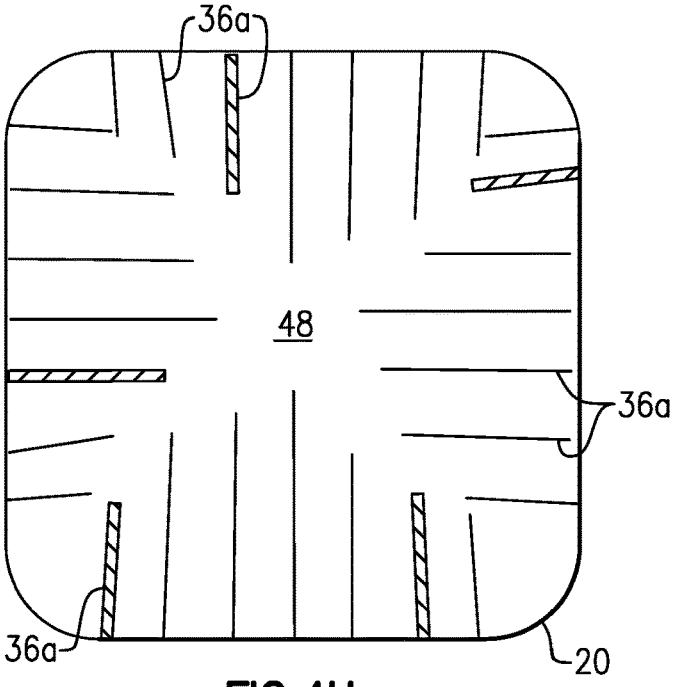
FIG. 4H shows another example embodiment.

FIG. 4H shows an example where the pipe 20 has a polygonal shape with an open space 48 that is an irregular shape. In the example shown, the pipe 20 comprises a square shape and the open space 48 comprises an opening that is defined by variable length bristles 36*a*. In addition to showing bristles 36*a* that have different lengths from each other, FIG. 4H also shows bristles 36*a* that have different thicknesses.

Figure 6:
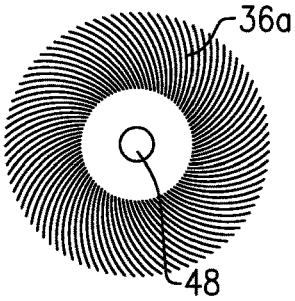
FIG. 6 is a schematic view of another example of example of a variable restriction valve.
Figure 7:
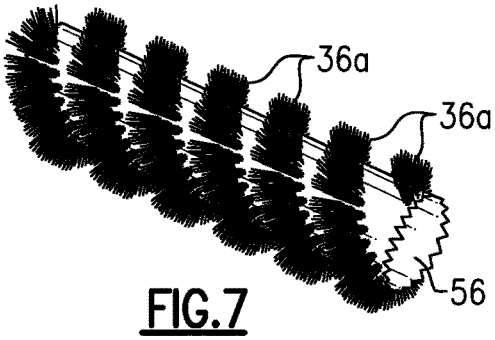
FIG. 7 is a schematic view of another example of example of a variable restriction valve.

FIG. 6 shows an example where the bristles 36*a* are provided in a spiral pattern. FIG. 7 shows another example of a spiral pattern where the bristles 36*a* are wound around a center piece 56 and extend along a predetermined length of the pipe 20 within which the center piece 56 is mounted.

As discussed above, the open space 48 or annulus can be in the middle of the band 40*a*, can comprise two or more spaces 48, can be offset from a center axis A, or an opening may not be required such that the configuration relies solely on the porosity/density of the fibers. The initial size of the open space 48 can be adjusted to control the restriction within the pipe. A larger open space will mean less initial restriction and the restriction will change more slowly as a function of pressure. A smaller open space will mean more initial restriction and the restriction will change more quickly as a function of pressure. The valve 30 includes an optional guide component 52 to control deflection of the bristles 36*a* and prevent mechanical stresses that can cause bristles to permanently deform, which is a risk during high temperature exposure.

Figure 5:
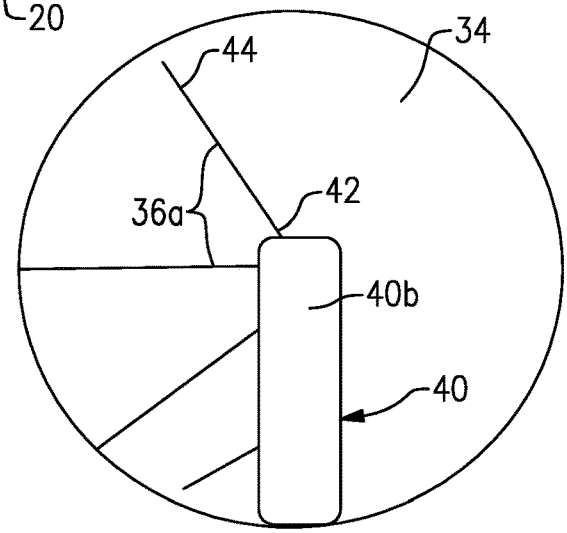
FIG. 5 is a schematic view of another example of a variable restriction valve.

FIG. 5 shows an example where the rigid mount structure 40 comprises a center post rib or post 40*b* that extends into the exhaust gas passage 34. The first ends 42 of the bristles 36*a* are fixed to the post 40*b* and the free ends 44 extend outwardly from the post 40*b* toward the inner surface 32 of the pipe 20.

Figure 8A:
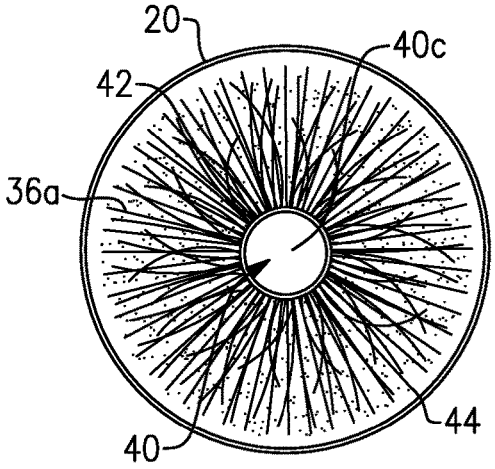
FIG. 8A is a schematic view of another example of example of a variable restriction valve.
Figure 8B:
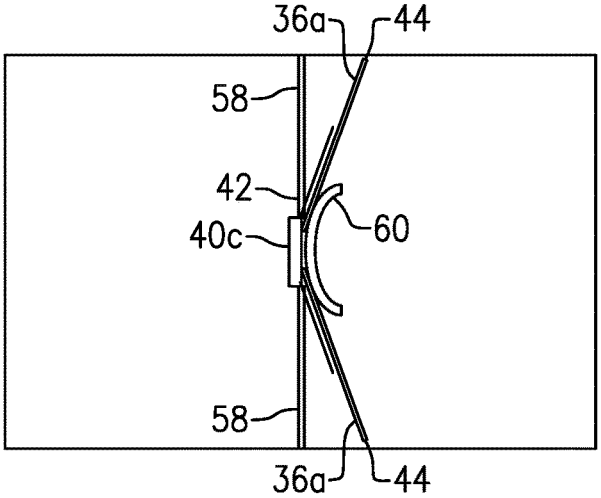
FIG. 8B is a side view of the valve of FIG. 8A.

FIGS. 8A-8B show another example of a center mount configuration. In this example, the rigid mount structure 40 comprises an inner grommet 40*c* positioned within the exhaust gas passage 34 to define a mount interface that is spaced from the inner surface 32 of the pipe 20. The bristles 36*a* extend outwardly from the mount interface toward the inner surface 32 of the exhaust gas passage 34. One or more supports 58 are attached to the pipe 20 and extend radially inwardly to support the grommet 40*c*. The first ends 42 of the bristles 36*a* are connected to the grommet 40*c* and the free ends 44 extend toward the inner surface 32 of the pipe 20. The grommet 40*c* includes a mechanical stop or guide 60 formed on a downstream side of the grommet 40*c* to reduce stress and prevent the bristles from being permanently deformed. In this configuration, when the bristles 36*a* bend in response to increased exhaust gas pressure, a variable annulus 62 is provided about an outer periphery of the bristles 36*a*. The shape of the pipe and the configuration of the bristles 36*a* can take the form of any of the configurations discussed above.

Figure 9A:
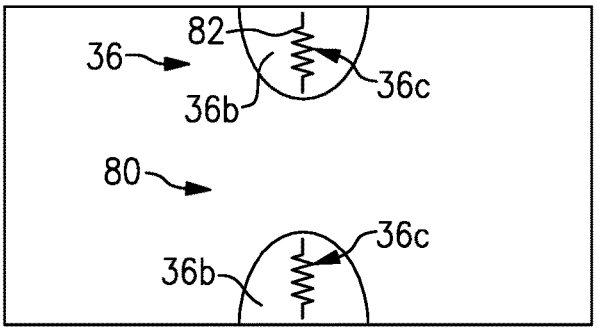
FIG. 9A is a schematic side view of another example of example of a variable restriction valve.
Figure 9B:
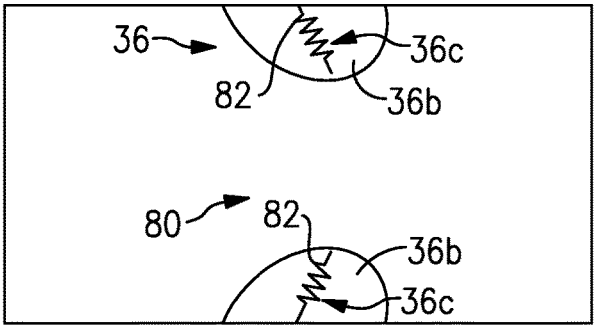
FIG. 9B is similar to 9A but showing an increased open area
Figure 10:
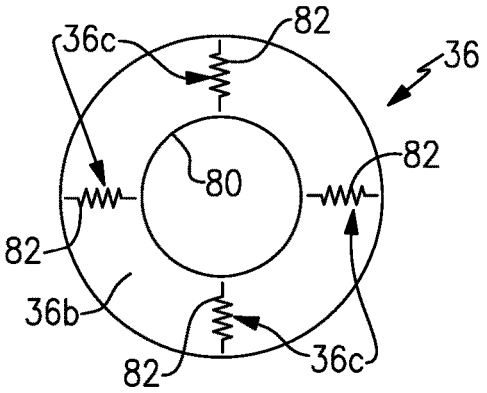
FIG. 10 is a front view of the example of FIG. 9A.

FIGS. 9A-9B show another example of a flexible member 36 that comprises a flexible material member 36*b* with internal stiffener members 36*c*. FIG. 10 shows a front view of the members 36*b*, 36*c* of FIGS. 9A-B. In this example, the members 36*b*, 36*c* are positioned within the pipe 20 to provide an annulus 80. The flexible material member 36*b* is comprised from a textile or fabric, e.g. a woven metal mesh or textile similar to that used in flex joints. The textile itself when formed into an annulus 80 as shown in FIG. 10 provides a certain amount of stiffness. The stiffness can be controlled and increased as necessary by the use of springs 82, or by providing a member made from a flexible material that is embedded inside the material member 36*b* such as a low density silicon or foam, for example, or by providing an element that can provide stiffness but deflect when subjected to a force. The stiffeners 36*c* have one end fixed to the pipe 20 and the opposite end is freely moveable. When the exhaust gas flow increases pressure at the orifice location, the mesh annulus will deform and become bigger as shown in FIG. 9B. As the annulus becomes bigger, the restriction of the valve will decrease so that as the flow continues to increase the pressure drop due to the valve does not become too high. This configuration provides for smooth flow with minimal flow noise.

Figure 11:
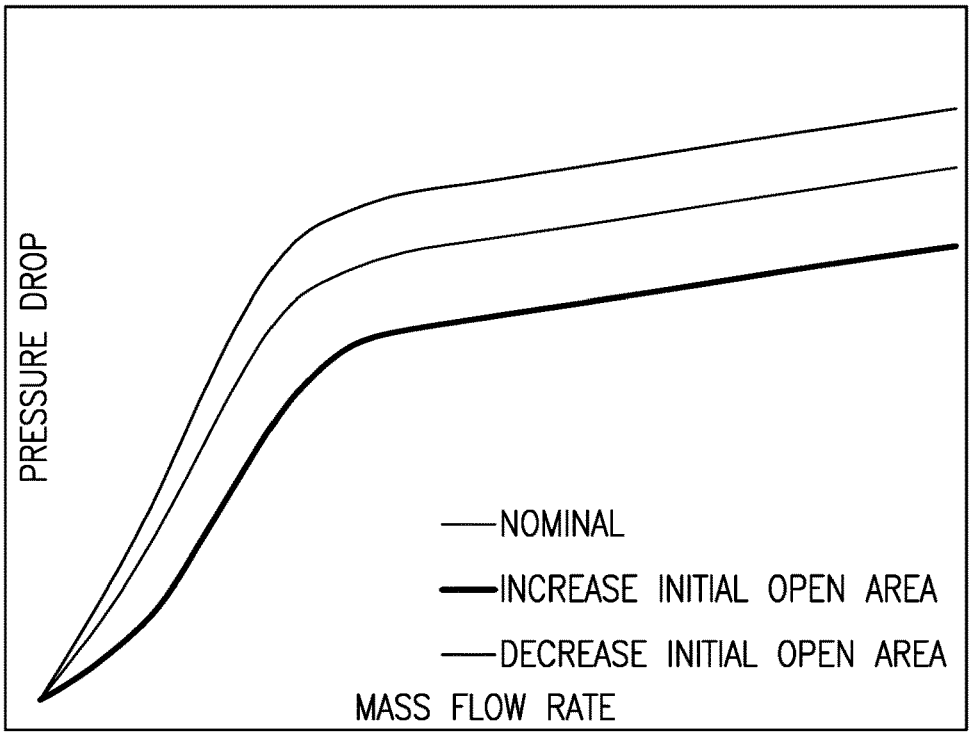
FIG. 11 shows the pressure drop versus flow rate for a nominal open area, an increased initial open area, and a decreased initial open area.
Figure 12:
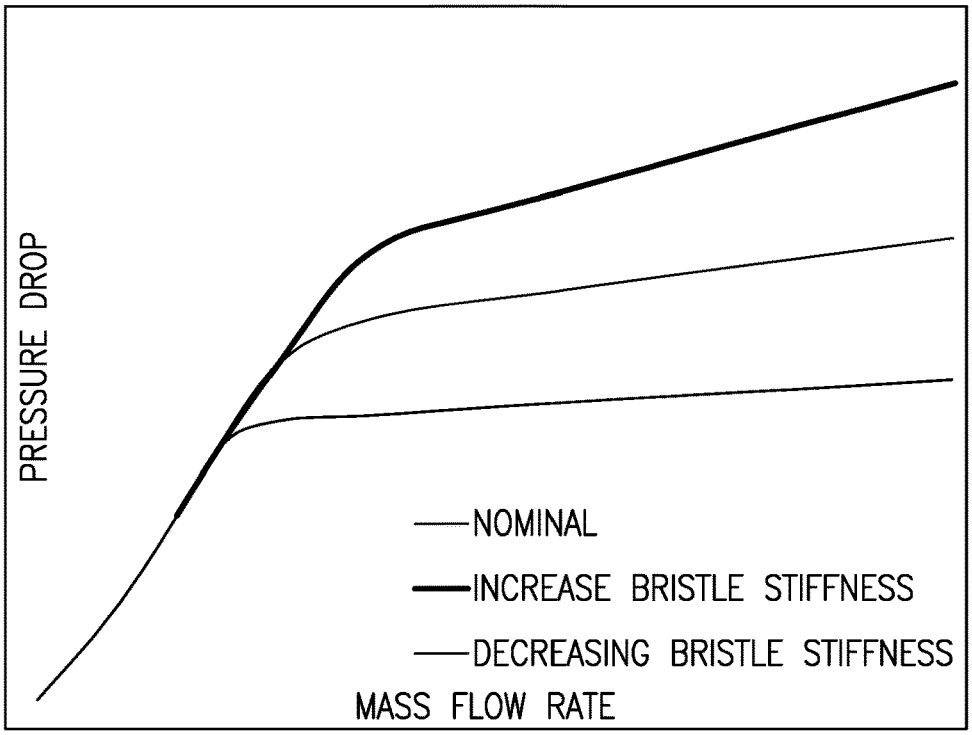
FIG. 12 shows the pressure drop versus flow rate for a nominal bristle stiffness, an increasing bristle stiffness, and a decreasing bristle stiffness.

As discussed above, to provide the variable restriction, the members are configured to bend from an initial position, e.g. a low flow or no flow condition, to increase an open area within the exhaust gas passage in response to increased exhaust gas pressure above a predetermined level, and then return to the initial position when the exhaust gas pressure falls below the predetermined level. When the members are bent or fully-deformed, a max flow condition is provided. FIGS. 11 and 12 show how the restriction of the valve versus the flow rate will change as a function of initial open area and bristle stiffness which is a function of bristle geometry and material.

FIG. 11 shows the pressure drop versus flow rate for a nominal open area, an increased initial open area, and a decreased initial open area. Increasing the initial open area provides for a lower pressure drop as compared to decreasing the initial open area. FIG. 12 shows the pressure drop versus flow rate for a nominal bristle stiffness, an increasing bristle stiffness, and a decreasing bristle stiffness. Decreasing bristle stiffness provides for a lower pressure drop as compared to increasing bristle stiffness.

As one example, a 70 mm round pipe, or other shaped pipe with an equivalent area, which includes the variable restriction will have the following characteristics. For example, the open area with the no-flow (non-deformed) condition will have a range of 300 to 700 $mm^2$ and the open area with the max-flow (fully deformed) condition will have a range of 1590 to 2400 $mm^2$. In one example, the bristle area (length×diameter×#of bristles) as a function of the total inner cross-sectional area of the pipe will be within a range of 45% to 260%. In one example, the bristles are made from steel and includes a width/diameter range of 0.1 to 0.5 mm. It should be understood that these are just examples and other configurations could be used dependent upon the application and design parameters.

Figure 13:
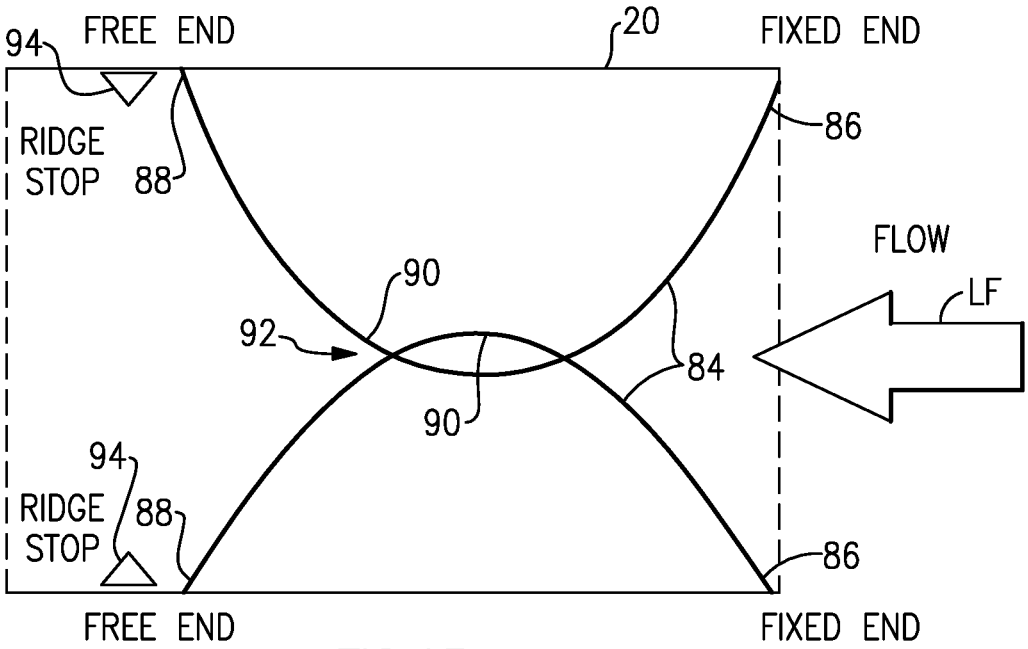
FIG. 13 is a schematic view of another example of example of a variable restriction valve in a no flow or low flow condition.
Figure 14:
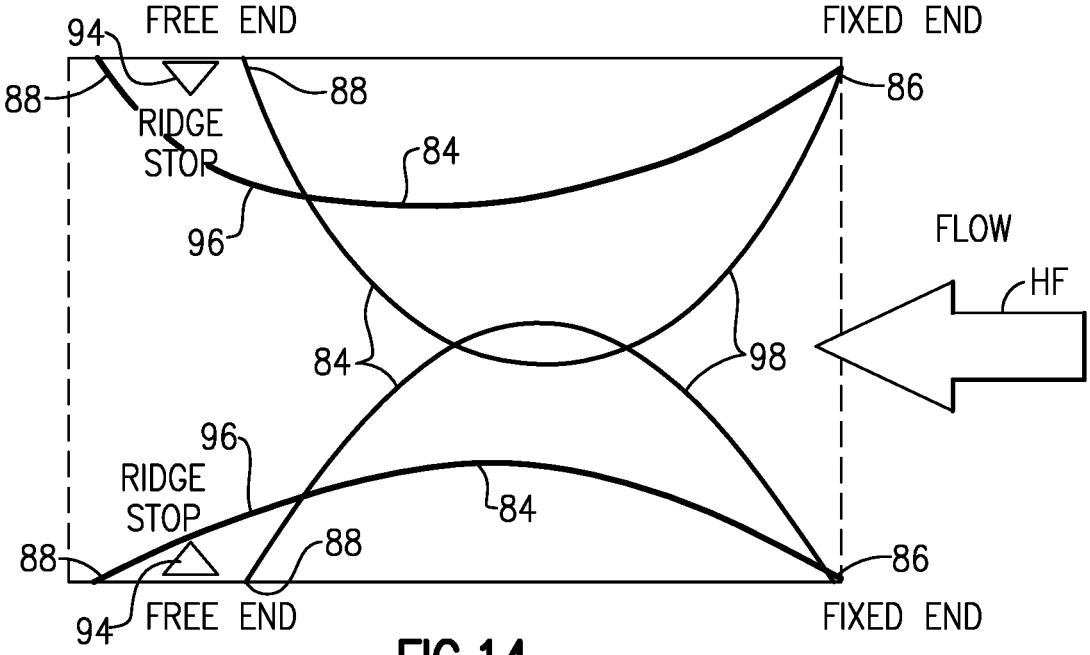
FIG. 14 is the valve of FIG. 13 but which shows a high flow condition.

FIGS. 13-14 show another example of a variable restriction that includes a plurality of bristles 84 having fixed ends 86 that are secured to the pipe 20 and free ends 88 that are free to move in response to changes in exhaust gas flow pressures. In this example, the bristles 84 have a bent or curved portion 90 in their static position without any external force or flow. The bristles 84 have a length such that the bristles 84 interfere or abut directly against each other at a center or middle of the restriction as indicated at 92. The bristles 84 are also long enough such that the free ends 88 touch the wall of the pipe 20.

One or more ridge stops 94 are provided within the flow path to create a positioned feature that the bristles 84 will push up against under low flow conditions. Under high flow conditions, the free ends 88 of the bristles 84 will push past, e.g. deform over, the ridge stops 94. The ridge stops 94 can be created by using ridge-lock or sizing tooling to produce a protrusion extending radially inwardly from the wall of the pipe 20 to provide the positive feature to interact with the bristles 84.

The described interferences/contact areas will create friction, which will increase the force required to move, distort, or bend the bristles 84. When exposed to an external force/flow, and depending on the force value, the bristles 84 will overcome the friction forces at the wall of the pipe 20, at the ridge stops 94, and also overcome the friction generated due to interference between the bristles 84 themselves.

FIG. 13 shows a static or low flow LF position of the bristles 84 from a side view. The bristles 84 have a large radius of curvature such that they interfere with each other at the middle of the pipe 20, e.g. near a pipe center axis. The bristles 84 have the free ends 88 in contact with the pipe 20 and are located at an upstream position relative to the ridge stops 94. FIG. 14 shows a high flow HF position, indicated at 96, which is overlapping the no or low flow position, as indicated at 98. In the high flow position, the bristles 84 have a smaller radius of curvature such that the bristles 84 do not interfere with each other near a center of the pipe to provide an open area. The free ends 88 of the bristles 84 have also pushed past the ridge stops 94 such the ends 88 are at a downstream position to provide maximum flow.

The subject valve 30 provides several advantages over traditional valves. The subject valve is significantly lower in cost than current active and passive valve configurations. Further, the subject valve 30 does not suffer from the NVH issues that typically plague active and passive valves. Additionally, the subject valve can be located in many different locations including mufflers, for example, which makes it the valve.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A valve assembly for a vehicle exhaust system comprising:

a rigid mount structure configured to be mounted within an exhaust component defining an exhaust gas passage;

a plurality of flexible members each extending from a first end to a second end, and wherein one of the first ends and second ends of the flexible members are fixed to the rigid mount structure and the other of the first ends and second ends are freely moveable ends that are each free to move relative to each other such that the plurality of flexible members creates a variable restriction to flow through the exhaust component that varies in response to a pressure difference upstream and downstream of the plurality of flexible members; and wherein at least some of the flexible members are partially overlapping each other, and wherein each freely movable end bends in a downstream direction from an initial position to increase an open area within the exhaust gas passage in response to increased exhaust gas pressure above a predetermined level, and wherein the freely moveable ends each freely move in an upstream direction to return to the initial position when exhaust gas pressure falls below the predetermined level.

2. The valve assembly according to claim 1, wherein, when in the initial position, the freely movable ends of the plurality of flexible members are spaced apart from each other to define an open space radially inward of the freely movable ends, and wherein the freely movable ends bend from the initial position to increase the open space within the exhaust gas passage in response to increased exhaust gas pressure above the predetermined level.

3. The valve assembly according to claim 2, wherein the exhaust gas passage defines a center axis, and wherein the open space is concentric with the center axis.

4. The valve assembly according to claim 2, wherein the exhaust gas passage defines a center axis, and wherein the open space is non-concentric with the center axis.

5. The valve assembly according to claim 2, wherein the open space comprises at least two separate annuli.

6. The valve assembly according to claim 1, wherein the rigid mount structure comprises an outer band defining an inner surface surrounding the exhaust gas passage, and wherein the flexible members extend outwardly from the inner surface toward a center of the exhaust gas passage.

7. The valve assembly according to claim 6, wherein the outer band is circular, ovoid, or elliptical.

8. The valve assembly according to claim 6, wherein the outer band is polygonal.

9. The valve assembly according to claim 1, wherein the rigid mount structure comprises an inner mount positioned within the exhaust gas passage to define a mount interface that is spaced from an inner surface of the exhaust component, and wherein the flexible members extend outwardly from the mount interface toward the inner surface of the exhaust component.

10. The valve assembly according to claim 1, wherein the plurality of flexible members comprises a plurality of stiffener members that are inside a flexible material.

11. The valve assembly according to claim 1, wherein the plurality of flexible members comprises a plurality of bristles.

12. The valve assembly according to claim 11, wherein the bristles have varying lengths and/or thicknesses.

13. The valve assembly according to claim 11, wherein the bristles are formed as a spiral structure that extends along a predetermined length of the exhaust component.

14. The valve assembly according to claim 1, wherein each freely movable end moves between an initial position to a bent position where the freely movable ends are downstream from the initial position of the freely movable ends, and wherein the freely movable ends bend independently of each other while moving between the initial and bent positions.

15. The valve assembly according to claim 1, wherein the plurality of flexible members extend generally perpendicularly relative to a center axis defined by the exhaust gas passage when in the initial position.

16. A valve assembly for a vehicle exhaust system comprising:

a rigid mount structure configured to be mounted within an exhaust component defining an exhaust gas passage; and a plurality of flexible members each extending from a first end to a second end, and wherein one of the first ends and second ends of the flexible members are fixed to the rigid mount structure and the other of the first ends and second ends are freely moveable ends that are each free to move relative to each other such that the plurality of flexible members creates a variable restriction to flow through the exhaust component that varies in response to a pressure difference upstream and downstream of the plurality of flexible members, wherein the plurality of flexible members comprises a plurality of bristles, and wherein the bristles overlap each other to define a bristle density that can be varied to provide a desired variable open area in relation to the predetermined level of exhaust gas pressure.

17. A valve assembly for a vehicle exhaust system comprising:

a rigid mount structure configured to be mounted within an exhaust component defining an exhaust gas passage;

a plurality of flexible members each extending from a first end to a second end, and wherein one of the first ends and second ends of the flexible members are fixed to the rigid mount structure and the other of the first ends and second ends are freely moveable ends that are each free to move relative to each other such that the plurality of flexible members creates a variable restriction to flow through the exhaust component that varies in response to a pressure difference upstream and downstream of the plurality of flexible members; and a guide positioned downstream from the plurality of flexible members to define a bend stop position for the flexible members when the exhaust gas pressure exceeds the predetermined level.

18. A vehicle exhaust component assembly comprising:

an exhaust component body having an inner surface defining an exhaust gas passage;

a rigid mount structure positioned within the exhaust gas passage;

a plurality of flexible members each extending from a first end to a second end, and wherein the plurality of flexible members comprise a plurality of bristles or stiffeners, and wherein the first ends of the flexible members are fixed to the rigid mount structure and the second ends are freely moveable ends that are each free to move relative to each other such that the plurality of flexible members creates a variable restriction to flow through the exhaust component body that varies in response to a pressure difference upstream and downstream of the plurality of flexible members;

wherein the freely movable ends bend from an initial position to increase an open area within the exhaust gas passage in response to increased exhaust gas pressure above a predetermined level, and wherein the freely moveable ends return to the initial position when exhaust gas pressure falls below the predetermined level; and a guide positioned downstream from the plurality of flexible members to define a bend stop position for the flexible members when the exhaust gas pressure exceeds the predetermined level.

19. The vehicle exhaust component assembly according to claim 18, wherein the rigid mount structure comprises an outer band defining an inner surface surrounding the exhaust gas passage, and wherein the flexible members extend outwardly from the inner surface toward a center of the exhaust gas passage, and wherein the open area comprises one or more annuli positioned adjacent a center of the exhaust gas passage.

20. The vehicle exhaust component assembly according to claim 18, wherein the rigid mount structure comprises an inner mount positioned within the exhaust gas passage to define a mount interface that is spaced from the inner surface of the exhaust component body, and wherein the flexible members extend outwardly from the mount interface toward the inner surface of the exhaust component body such that the open area comprises an annulus between the inner surface and the freely moveable ends.

21. The vehicle exhaust component assembly according to claim 18, wherein the freely movable ends move between the initial position to a bent position where the freely movable ends are downstream from the initial position of the freely movable ends, and wherein the freely movable ends bend independently of each other while moving between the initial and bent positions.

22. The vehicle exhaust component assembly according to claim 18, wherein the plurality of flexible members extend generally perpendicularly relative to a center axis defined by the exhaust gas passage when in the initial position.

* * * * *